United States Patent [19]

Altmayer

[11] 4,201,990

[45] May 6, 1980

[54] TUNABLE DIPOLE ANTENNA

[75] Inventor: John Altmayer, Cape Coral, Fla.

[73] Assignee: Hustler, Inc., Kissimmee, Fla.

[21] Appl. No.: 818,009

[22] Filed: Jul. 22, 1977

Related U.S. Application Data

[63] Continuation-in-part of Ser. No. 569,794, Apr. 21, 1975, abandoned.

[51] Int. Cl.[2] ..... H01Q 9/16

[52] U.S. Cl. ..... 343/747; 343/750; 343/822; 343/823

[58] Field of Search ..... 343/747, 749, 750, 816, 343/820, 823, 822

[56] References Cited

U.S. PATENT DOCUMENTS

| | | | |
|---|---|---|---|
| 2,413,451 | 12/1946 | Johnson | 336/79 |
| 2,563,243 | 8/1951 | Hills | 343/747 |
| 3,530,410 | 9/1970 | Parker | 343/822 |
| 3,540,057 | 11/1970 | Persson et al. | 343/750 |
| 3,623,113 | 11/1971 | Faigen | 343/747 |
| 3,671,972 | 6/1972 | Spilsbury | 343/750 |

*Primary Examiner*—Eli Lieberman

*Attorney, Agent, or Firm*—Meyer, Tilberry & Body

[57] ABSTRACT

A radio antenna having linear radiating elements, a loading coil electrically connected to these linear radiating elements and a tuning disc located within the loading coil and rotatable about a diameter of the loading coil whereby said antenna can be easily and accurately tuned to the exact frequency of operation selected. The disc is preferably electrically conductive such that when its plane is perpendicular to the axis of the coil the coil will have a minimum inductance.

11 Claims, 5 Drawing Figures

TUNABLE DIPOLE ANTENNA

This application is a continuation-in-part application of copending application Ser. No. 569,794 filed Apr. 21, 1975, now abandoned.

This invention pertains to the art of radio antennas and more particularly, to radio antennas using loading coils and capable of being tuned by modifying the inductance of said loading coils.

The radio antenna is particularly adaptable for use by radio amateurs in their assigned frequency bands and will be described with particular reference thereto. In particular, the invention will be described with reference to a centerloaded dipole antenna operable in what is known as the 20, 40 and 75 meter amateur bands. It will be appreciated that the invention is equally applicable to operation in the other amateur bands or other types of radio service with appropriate dimensioning or sizing of electrical components and, as illustrated in a second preferred embodiment, can be used in a bottom loaded vertical antenna. Further, the invention can be used in a mono-band antenna of either the bottom loaded vertical type or centerloaded dipole type.

In the amateur radio service, it is considered desirable to have a single antenna which will readily transmit efficiently at various frequencies within the same band and also on a number of different bands of frequency. Heretofore, this has been accomplished by means of traps positioned at exact locations along the length of the antenna which traps must be accurately tuned and preset for the desired bands of operation. Each trap acts as a loading coil for the next lower frequency. One of the problems with such antennas has been that they have an optimum frequency of operation in each band which can be readily determined by placing a standing wave ratio indicator in the feed line from the transmitter to the antenna. The standing wave ratio on the feed line will drop from a maximum to a minimum and then rise again to a maximum as the frequency of the transmitter is tuned through the resonant frequency of the antenna. In order to change the resonant frequency, it has been necessary to vary the length of the antenna elements or the number of turns in a loading coil or both which, unless some provision for remote turning is provided, is impossible without an undue amount of work consisting of lowering the antenna from a mast, making the adjustment, replacing the antenna, checking the resonant frequency, and if it is not correct, repeating the operation until the desired resonant frequency is obtained.

One solution to this problem was proposed in U.S. Pat. Nos. 3,327,311 and 3,419,969 and assigned to the assignee of this application. Such patents describe a remotely tuned, band switchable antenna wherein a dipole antenna was provided having a loading coil in each dipole element which lowered the resonant frequency such that the antenna could then be resonated to the desired operating frequency by means of telescoping tips in the elements which could be extended or retracted by means of a motor located in a housing at the center of the antenna. Additionally, a switch on each coil actuated by a second motor in the housing through a flexible cable was provided whereby portions of the loading coils could be shorted out thereby raising the resonant frequency. Thereafter the telescoping tips could again be adjusted to resonate the antenna within the new frequency band of operation. Such antenna proved quite satisfactory but was expensive to build and because of the movable parts exposed to the weather, sometimes gave difficulties particularly at temperatures below freezing. It is to be noted that such antenna had on overall physical length less than the electrical length necessary for resonance at the lowest band or frequency of operation, and the resonant frequency was then lowered by means of the loading coils positioned between the ends of each dipole element.

Various relay actuated switching arrangements are also known although none like the switching arrangements of the present invention.

It has further been known to provide a shortened antenna consisting of a continuous open pitched coil coupled to a coaxial feed line through a multi-turn loop surrounding the coil at its mid point. (See American Radio Relay League "Antenna Handbook" (1974) page 220). Such antenna was provided with short linear elements at the ends which either had to be telescoped or cut off to make the antenna resonate at a desired frequency. Such antenna was resonant at only one frequency within the band. A shift in operating frequency within the band of operation resulted in either a reduced radiating efficiency for the antenna or a high standing wave ratio on the feed line or both. Both of these conditions result in less power radiated by the antenna.

The present invention provides a tunable transmitting antenna which is relatively simple in construction, has a maximum electrical efficiency and which is readily tuned to the exact frequency of operation.

In accordance with the present invention, a radio antenna is provided comprised of linear radiating elements having an electrical length less than that necessary for resonance at maximum desired frequency of operation, in combination with a multi-turn loading coil positioned between the adjacent ends of the radiating elements and electrically connected in series between the radiating elements by means of at least two taps, coupling means coupling the loading coil to a feed line and a tuning disc to effect the inductance of the loading coil positioned within the loading coil and rotatable about a diameter of the coil thereby causing the antenna to resonate at any selected frequency within the band.

Further in accordance with the invention, the disc is preferably rotated at slow speeds by a unidirectional gear motor energized through a push button switch. The motor is thus of a simpler design and the wiring circuitry is simplified.

Further in accordance with the invention, the disc consists of metal of high electrical conductivity such as silver, copper or aluminum.

In the case of a multi-band dipole antenna, in accordance with the invention, relays or solid state switching circuits connect pairs of taps symmetrically spaced from the mid plane of the loading coil to adjacent ends of linear radiating elements and the disc is located on the mid plane of the coil.

By having the length of the element (s) such that it (they) resonate at a frequency above the maximum frequency of operation, it is necessary to employ at least one turn in the loading coil to lower the resonant frequency to the highest desired frequency of operation. It is then possible to couple the feed line to the antenna at all frequencies of operation by means of a loop rather than a direct electrical connection. At the same time, it is possible to then increase the resonant frequency of the antenna by means of the tuning disc on all bands of operation to the desired frequency of operation.

Heretofore in order to have a coil loaded antenna appear to operate efficiently (i.e. have a low standing wave ratio in the feed line) over a wide band of frequencies, it was considered necessary to lower the Q of the loading coil in some manner such as by increasing its resistance or using a poor shape factor, or both which reduced the overall radiating efficiency of the antenna. These losses are dissipated as heat in the antenna and its feed line and do not radiate energy into space. Using the tuning arrangement of the present invention, all elements and coils can be designed for maximum Q which reduces the losses within the antenna itself resulting in a greater efficiency of energy radiated into space.

If the frequency of the electrical energy being supplied an antenna is different than the resonant frequency of the antenna, the feed line will see either an inductive or a capacitive reactance which results in losses in the antenna and to a smaller extent in the feed line. Using the present invention, it is possible to tune the antenna so as to be exactly resonant at the frequency of the transmitter so that the feed line sees only pure radiation resistance and the inductive and/or capacitive reactance is zero. Maximum radiating efficiency results.

The principle object of the invention is the provision of a new and improved tunable transmitting antenna which is simple in construction, economical to manufacture and which has a maximum radiating efficiency.

Another object of the invention is the provision of a new and improved remotely switched, remotely tuned multi-band transmitting antenna which is simple in construction, economical to manufacture and which has a maximum radiating efficiency.

Another object of the invention is the provision of a new and improved radio antenna of the type described having an improved and simple means for tuning the antenna to the exact frequency of operation.

Another object of the invention is the provision of a new and improved radio antenna of the type described wherein a tuning disc may be simply rotated throughout its entire tuning range and back by means of a unidirectional electric drive motor.

Another object of the invention is the provision of a new and improved radio antenna of the type described wherein power may be fed to the antenna on all the bands of operation by means of loop coupling to a coil from a transmission line whereby the antenna is electrically symmetrical and impedence matching is simplified.

Another object of the invention is the provision of a multi-band radio antenna wherein the bands of operation are readily selected by means of small relays or solid state switching circuits.

Another object is the provision of a new and improved tuning arrangement for an antenna comprised of a loading coil and a disc, either electrically conductive or magnetically permeable, within the coil the plane of which is rotatable on a diameter of the coil.

The invention may take physical form in certain parts and arrangements of parts, preferred embodiments of which will be described in this specification and illustrated in the accompanying drawing which form a part hereof and wherein.

Figure 1:
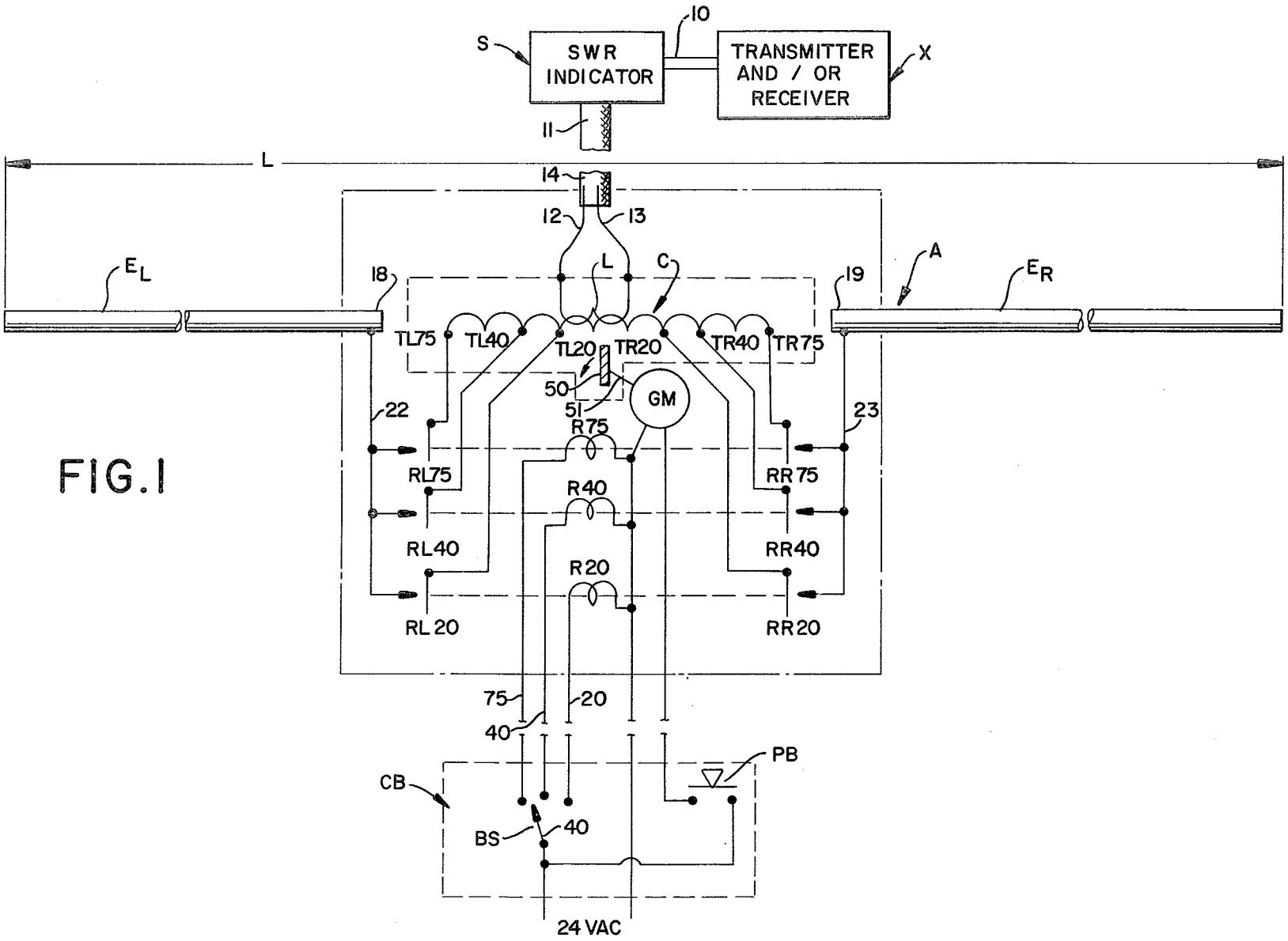
FIG. 1 shows a schematic diagram of a multi-band dipole radio antenna and control arrangement illustrating principles of the invention.

Referring now to the drawings wherein the showings are for the purposes of illustrating preferred embodiments of the invention only and not for the purposes of limiting same, FIG. 1 shows a diagrammatic view of a complete radio transmitting system using the antenna of the present invention. In this Figure, a radio transmitter and/or receiver X is shown connected through a standing wave ratio indicator S to antenna A of the present invention. The antenna A has a remote control box CB having a band switch BS by which the band of operation of the antenna A may be selected and a push button PB by which the antenna A may be tuned over a range of frequencies within the band selected by the band switch BS.

The antenna A comprise a pair of aligned dipole elements $E_L$,$E_R$ with their respective right and left hand ends 18, 19 spaced and a loading coil C positioned therebetween. Three relays R20, R40 and R75 are provided, each having normally open contacts RL20, RR20; RL40, RR40; RL75, RR75 respectively which, when the appropriate relay is energized, are closed to connect respective taps on the coil C to the adjacent or inner ends 18, 19 of the dipole elements $E_L$,$E_R$.

Although not illustrated, solid state switching circuits could be used in place of relays R20, R40 and R75 and their associated contacts. These solid state switching circuits could be activated by switch BS or the circuitry could respond automatically to the frequency of the applied signal choosing the appropriate taps by causing only the appropriate solid state switching devices to conduct.

The transmitter and/or receiver forms no part of the present invention and is shown purely for the purposes of illustration. Ordinarily however, a transmitter and receiver will transmit and receive on the same or substantially the same frequency, as is conventional in amateur practice. The transmitter and/or receiver X is connected to the standing wave ratio indicator S by means of a conventional coaxial cable 10. The SWR indicator S in turn is connected to the antenna A through a conventional coaxial cable 11 which cable, as is conventional, has an outer braided shield 12 and a center conductor 13 coaxial with the braid 12 and separated therefrom by insulating material 14.

The elements $E_L$,$E_R$ are formed from electrically conductive material such as aluminum or copper and may take any conventional form such as solid wire but in the preferred embodiment are in the form of aluminum tubes held in spaced, aligned, insulated relationship by a housing H.

The overall length L from outer end to outer end of the elements $E_L$,$E_R$ which includes the spacing between the inner or adjacent ends 18, 19 is such that if the adjacent ends of the elements $E_L$,$E_R$ were electrically connected together by a short jumper, the resonant frequency would be somewhat greater than the maximum frequency of the highest frequency band of operation. In the preferred embodiment, the maximum frequency is 14 MHz and the length L is approximately 29 feet (8.4 meters) which will have a resonant frequency of approximately 15 MHz. The inner end 18 of the element $E_L$ is electrically connected to the fixed member of contacts RL20, RL40, RL75 through wire 22. In a like manner, the inner or adjacent end 19 of element $E_R$ is connected to the fixed members of contacts RR20, RR40, RR75, through wire 23.

The coil C has a plurality of turns of electrically conductive wire and is positioned between the adjacent or inner ends 18, 19. The total number of turns of this coil, their axial spacing and their diameter are such as to provide sufficient inductance that when connected in electrical series with the elements $E_L$,$E_R$, the resonant frequency of the antenna A will be less than the minimum frequency of operation e.g. 3.5 MHz. To connect the coil C in electrical series with the elements $E_L$,$E_R$, the coil C is provided with six taps reading from left to right, TL75, TL40, TL20, TR20, TR40, TR75, each of which taps is connected respectively to the movable members of contacts RL75, RL40, RL20, RR20, RR40, and RR75.

It will be appreciated that these contacts are all normally open and when any one relay R20, R40 or R75 is energized, its respective pair of contacts will close. The relays R20, R40, R75 are selectively energized by means of a band switch BS having its rotary arm 40 connected to a 24 volt AC source and connected to the respective relays by cabled conductors 20, 40 and 75.

The antenna A is energized from coaxial cable 11 by means of a multi-turn (preferably two turns) loop L which surrounds coil C midway between its axial ends and the terminals of this coil L are connected respectively, one to the inner wire 13 of coaxial cable 11 and the other to the shield 12. The feed to the antenna is thus electrically balanced.

The position of the tap TL20, TR20 on coil C are such that when relay 20 is energized, the resonant frequency of the elements $E_L$,$E_R$ and the turns between the taps TL20 and TR20 will be somewhat less than 14.0 MHz which as is known is the lower end of the 20 meter amateur band. In the same way, the position of taps TL40 and TR40 are such that the number of turns in the coil between these taps when connected in series with the elements $E_L$,$E_R$ by the energizing of relay R40 will be resonant at a frequency somewhat below 7.0 MHz.

For the purpose of tuning the resonant frequency of the elements $E_L$,$E_R$ in combination with the selected portions of coil C to be within the desired amateur band of operation and in accordance with the invention, means are provided for changing the inductance of those portions of coil C. In the embodiment shown, such means is comprised of a flat disc 50 of electrically conductive material either copper, aluminum or silver or copper or silver plated over an insulating base or other metal not ferro-magnetic and having a peripheral diameter approximately equal to the interior diameter of the coil C. This disc is mounted for rotation through 360° about its diameter on an axis parallel to a diameter of the coil C and generally midway between the ends of the coil. Thus, the disc 40 can be moved from a position where its plane is parallel to the axis of the coil C, in which case it has a minimum effect on the inductance of the coil C, to a position where its plane is transverse or perpendicular to the axis of the coil C, in which case it has a maximum effect on reducing the inductance of the coil C. It will be appreciated as the inductance of coil C is varied by rotating the disc, the resonant frequency of the elements $E_L$,$E_R$ and that portion of the coil in electrical series therewith by means of the selected relay will increase and decrease as the inductance of coil C changes.

The disc 50 may be rotated in any desired manner, but preferably by means of a unidirectional electric motor GM either having a slow rotational speed or a higher rotational speed with suitable gearing between its output shaft and the shaft 51 of the disc 50 that when the motor is energized, the disc will rotate at approximately 1 rpm. When the motor GM is energized from the 24 volt A.C. source by closing push button switch PB, the disc will rotate. An arc of 90° is all that is required to change the inductance of coil C from minimum to maximum or maximum to minimum. This requires 15 seconds. By momentarily activating the push button PB, a very fine degree of control can be obtained. By having the disc rotatable about an arc of 360°, a unidirectional motor may be employed. Because the speed of rotation is slow, accurate tuning is possible. Because the maximum time from maximum to minimum is low, the antenna can be tuned from a maximum SWR to a minimum under full power without damage to most transmitters.

In operation, the operator sets his band switch BS to the desired band of operation and his transmitter and receiver to the desired operating frequency in such band. The operator then listens on the receiver and energizes the gear motor GM to rotate the disc 50 until signals heard reach their maximum strength. The antenna tunes so sharply, particularly in the 75 meter band, that the antenna A can be tuned to almost exact resonance simply by noting the change in signal strength of received signals. The transmitter can then be turned on, preferably at low power. The SWR should be sufficiently close to its minimum as to permit immediate full power operation.

If a more accurate adjustment is desired, the operator can set his transmitter and receiver to the desired frequency in such band, set his transmitter in the "tune" or "low power" position. The SWR indicator S is read. The push button switch PB is depressed energizing the gear motor GM which rotates the disc 50. The operator observes the SWR indicator S until it goes through a minimum reading and just starts to increase. The antenna A is almost exactly tuned. However, if an even more optimum tuning is desired, the operator will remember the absolute low reading of the SWR indicator S and will allow the gear motor GM to continue operating while the SWR increases and then begins to decrease. The instant that the SWR indicator reaches the absolute low reading previously noted, the operator releases push button PB. The antenna is tuned to the exact frequency of the transmitter. The transmitter may then be switched on to full operating power. The transmitter can of course be tuned away from this exact frequency without unduly affecting the SWR.

By using elements $E_L$,$E_R$ of a combined overall length less than the electrical length of the maximum desired operating frequency of the antenna, it is necessary that some portion of coil C always be in electrical series with the elements $E_L$,$E_R$ on all bands. It is thus possible to use loop coupling from the coaxial cable 11 to the coil C. This would not be possible if the combined electrical length of the elements $E_L$,$E_R$ was such as to be resonant in the desired maximum frequency band of operation. This arrangement simplifies the switching circuitry.

Figure 2:
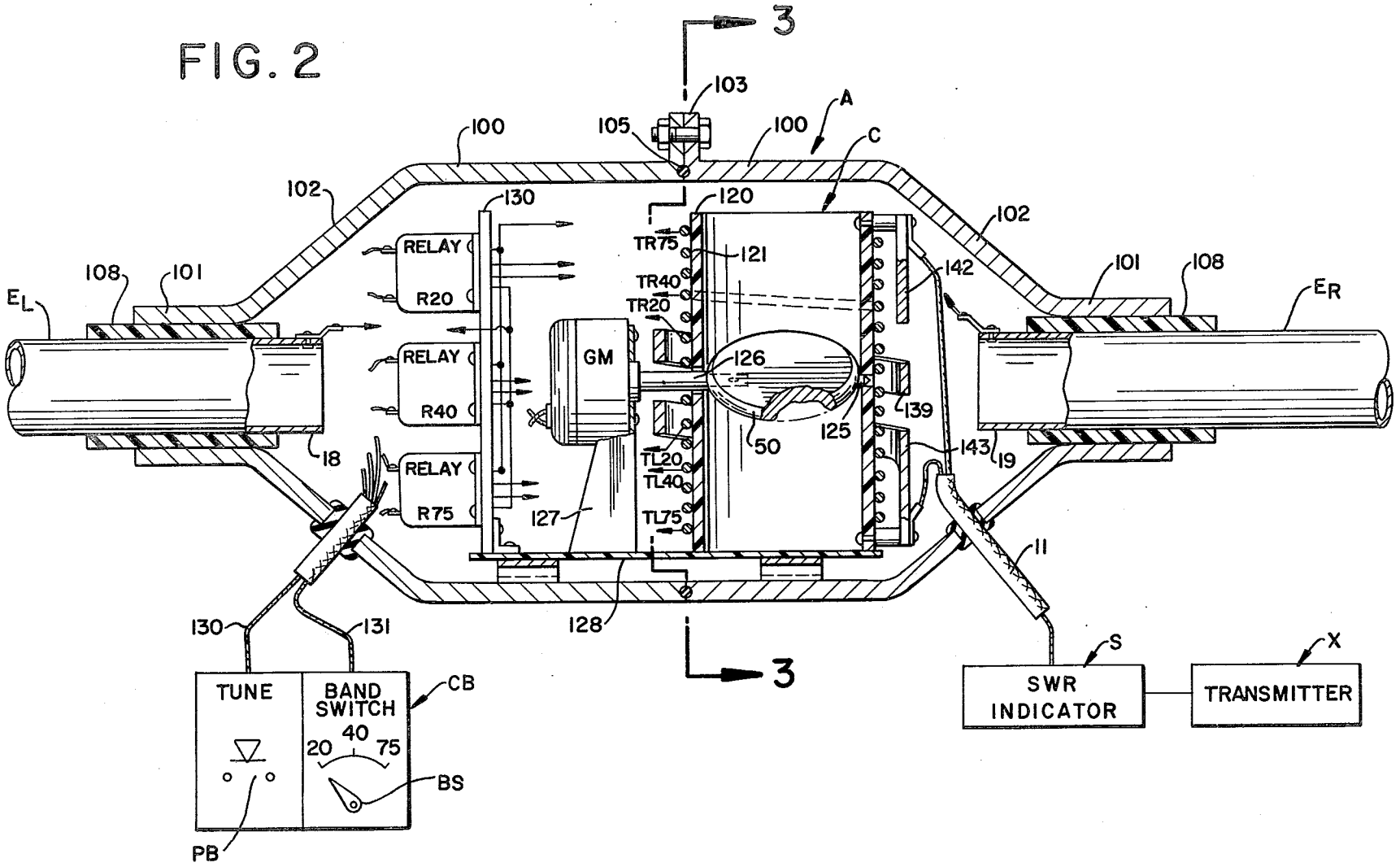
FIG. 2 is a cross-sectional view of the preferred embodiment shown schematically in FIG. 1.
Figure 3:
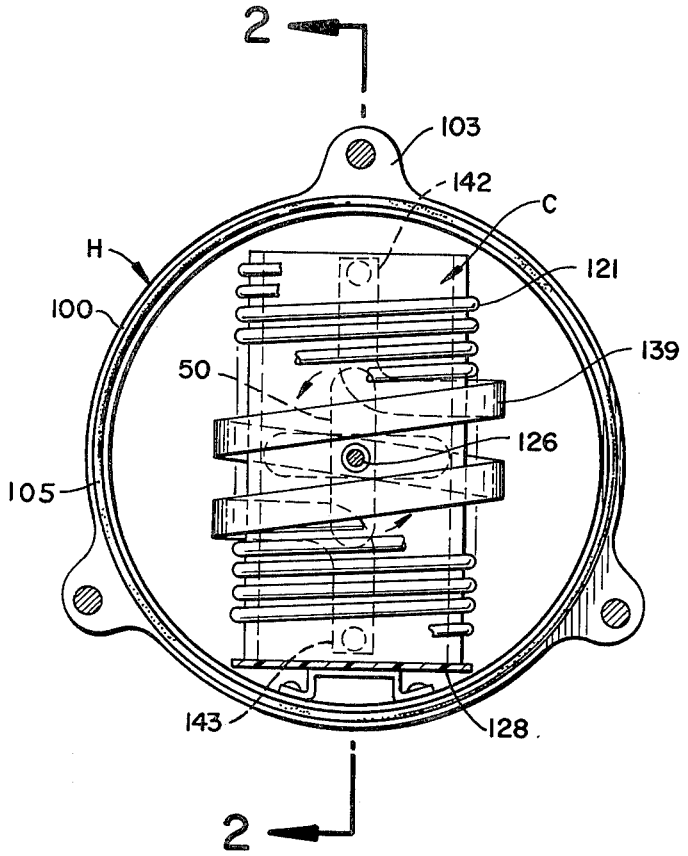
FIG. 3 is a cross-sectional view of FIG. 2 taken approximately on line 3—3 thereof.

FIG. 2 shows a cross-sectional view of a preferred physical embodiment of the invention. In this embodiment, there is a housing H comprised of two generally identical members each having a large diameter cylindrical portion 100 open at one end and tapering to a smaller diameter portion 101 through a conical portion 102. The open ends of the large diameter cylindrical portions 100 abutt and are provided with ears 103 which are bolted together generally as is shown. Preferably a waterproof seal 105 is placed between the abutting surfaces. The adjacent ends 18, 19 of elements $E_L$,$E_R$ extend into the cylindrical portions 101 and are electrically insulated therefrom by means of insulating sleeves 108. The elements $E_L$,$E_R$ are preferably of a lightweight aluminum tubing as is conventional and may taper in diameter towards their outer ends if desired.

The housing may be of metal or plastic. It should be strong enough to support the elements $E_L$,$E_R$. The antenna may be held in the air in any desired manner. Usually a mast coacting with the housing H supports the antenna.

Positioned within the housing is coil C. As can be seen, the coil C is comprised generally of a sleeve 120 of electrically insulating material having a wire 121 wound around its outer surface to form a helix having spaced turns. The ends of this wire 121 may be fastened to the insulating sleeve 120 in any desired manner. The wire 121 is preferably of a relatively large diameter copper, e.g. 12 gage, so as to have a minimum electrical resistance and therefore a minimum of electrical losses.

The disc 50 is mounted for rotation about its diameter on a diameter of the coil C midway between the axial ends of the coil C and is supported for such rotation by a pivot pin 125 extending into an opening in the sleeve 120 and by means of a shaft 126 threaded into one edge of the disc 50 and extending outside of the coil C to where it is mechanically coupled to the output shaft of gear motor GM mounted on a bracket 127 which is in turn mounted on a base 128 on which the coil C is also mounted.

Just to the left of the gear motor is a vertically extending mounting board 130 supported on the base 128 on which the relays R20, R40, and R75 are mounted. These relays are preferably of a type having contacts with a relatively large current rating and a 24 volt A.C. energizing coil. The gear motor GM as heretofore indicated preferably has an output rotational speed of 1 rpm and is preferably a 24 volt A.C. unidirectional motor.

The contacts of the relays are connected through heavy gage copper conductors (not shown) to the respective taps on coil C and the ends 18, 19 of elements $E_L$,$E_R$.

The three control lines 20, 40 and 75 and the gear motor energizing line 132 and the ground wire 131 for the relays and the gear motor are fed through the housing in any suitable manner preferably so as to be watertight.

Surrounding the turns of wire 121 on the outside of sleeve 120 is a coupling loop 139 preferably of two spaced turns made from flat copper strap and having axially extending legs 143, the ends of which are mounted on the outer ends of sleeve 120 in any suitable manner. The coaxial cable 11 enters the housing through a waterproof fitting. The inner conductor 13 connects to the upper end of leg 142 and the braid 14 connects to the lower end of leg 143.

It will be noted that this coupling coil is symmetrically located relative to the axial ends of the coil C. It is furthermore to be noted that for each band of operation, the coil C has two taps, one on each side of the mid plane of the coil C with one tap being connected to one of the elements $E_L$,$E_R$ and the other tap being connected to the other through respective relay contacts.

Figure 4:
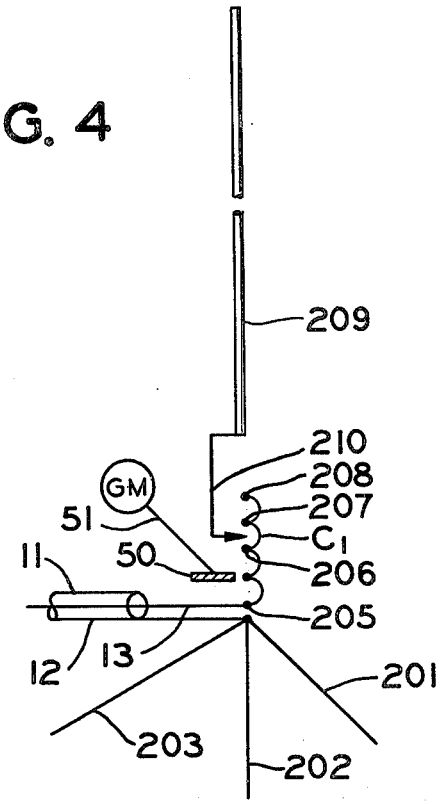
FIG. 4 shows a schematic diagram of a multi-band vertical radio antenna illustrating principles of the invention.

A second embodiment of the present invention is shown schematically in FIG. 4. The antenna illustrated is a multi-band quarter wave vertical antenna with a ground plane. The ground plane is shown as being composed of three radial elements 201, 202 and 203. However the ground plane can be composed of any number of radials or any other array of conductors as is conventional. The ground plane is connected to the outside conductor 12 of a coaxial transmission line 11. The center conductor 13 of the transmission line is connected to a tap 205 at one end of loading coil $C_1$ which in addition has taps 206, 207 and 208 along its length. The radiating element 209 is selectively connected to one of taps 206, 207, 208 through a rotary band switch 210 selecting the band of operation for the antenna. Relays or solid state switching circuits could be used in place of rotary band switch 210 to connect the radiating element 209 to the selected tap in a manner similar to that described in FIG. 1, however the relays or switching devices would not be paired as the ground plane is connected directly to the transmission line.

Disc 50 is positioned within the portion of the coil $C_1$ which is always connected between the transmission line and the radiating element such that rotation of the disc will always affect the resonant frequency of the antenna. The disc 50 may be rotated by a gear motor GM through a shaft 51 or manually by means of an exposed wheel attached to shaft 51.

The band switch 210 and the tuning disc 50 operate in a manner identical to the band switch and disc in the multi-band dipole antenna to tune the quarter-wave antenna to any selected frequency within a number of bands.

Again, the radiating element 209 may be formed from any electrically conductive material such as aluminum or copper but in the preferred embodiment is in the form of an aluminum tube having an overall length such that its unloaded resonant frequency is somewhat greater than the maximum frequency of the highest frequency band of operation. Therefore, a portion of the coil $C_1$ will always be connected in series with the radiating element 209.

This second embodiment operates in a manner similar to the antenna of the first embodiment. The ground plane in this structure forms an image of the vertical radiating element. Therefore, the radiation pattern of this antenna will resemble that of a vertical dipole. The characteristics of this antenna make it appear to have two linear radiating elements in vertical alignment with a loading coil between them.

Figure 5:
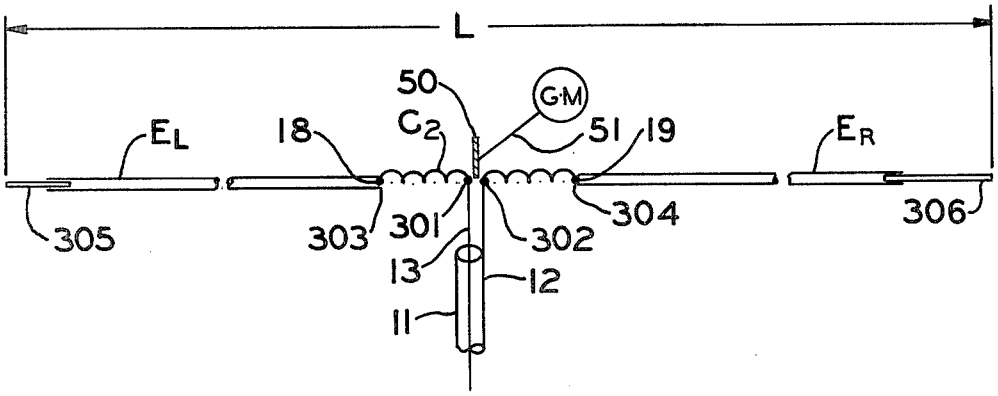
FIG. 5 shows a schematic diagram of a mono-band dipole radio antenna illustrating principles of the invention.

A third embodiment of the present invention is schematically illustrated in FIG. 5. FIG. 5 shows a monoband dipole antenna having a split central loading coil $C_2$. Two adjacent taps 301, 302 are formed at this split for connecting loading coil $C_2$ to transmission line 11. Radiating elements $E_L$ and $E_R$ are connected at their adjacent ends 18, 19 to coil $C_2$ through end taps 303, 304. Disc 50 is located within coil $C_2$ at its center and may be rotated by gear motor GM through shaft 51. Rotation of disc 50 will easily adjust the resonant frequency of the antenna throughout its operating range.

Preferably radiating elements $E_L$ and $E_R$ are fabricated from aluminum tubing. In this embodiment radiating element extensions 305 and 306 may be telescoped into the ends of $E_L$ and $E_R$. Upon initial installation of the antenna extensions 305 and 306 may be adjusted to balance the antenna and overcome the effects of any nearby interfering structures such as large metallic surfaces.

The invention has been most fully described with reference to a multi-band dipole antenna. It will be appreciated that the variations described with respect to this embodiment can also be applied to the vertical quarter-wave embodiment and the mono-band dipole embodiment. Further the direct coupling shown in the quarter-wave vertical antenna embodiment or the mono-band dipole antenna embodiment could be adapted for use with the multi-band dipole antenna of FIG. 1.

The disc 50 could of course be of magnetic permeable material conventionally used for tuning radio frequency coils in which case as the plane of the disc is moved to be perpendicular to the axis of the coil, the inductance of the coil increases.

Either choice will change the resonant frequency of the antenna as it is moved relative to the coil although obviously in different directions.

The invention has been described with reference to three preferred embodiments. Obviously, modifications and alterations will occur to others upon reading and understanding of this specification and it is my intention to include all such alterations and modifications insofar as they come within the scope of the appended claims.

Having thus described my invention I claim:

1. A remotely, tuned, band-switched dipole antenna comprised of a single pair of elongated dipole elements in aligned relationship with their adjacent ends in electrically insulated relationship, a multi-turn coil of electrically conductive material positioned adjacent said adjacent ends, said coil having at least a pair of spaced taps, one on each side of its center plane, means connecting a pair of said taps to respective adjacent ends of said dipole members, a disc of a material to affect the inductance of said coil positioned within said coil midway between the ends of said coil and rotatable about a diameter of said coil from a first position where the plane of said disc is perpendicular to the axis of said coil to a second position, motor means for rotating said disc between said positions and means remote from said antenna for actuating said motor whereby said antenna may be electrically tuned from a remote point; said means for connecting said taps on said coil to said adjacent ends of said dipole elements including relays having contacts thereon and means for selectively energizing said relays.

2. A remotely, tuned, band-switched dipole antenna comprised of a single pair of elongated dipole elements in aligned relationship with their adjacent ends in electrically insulated relationship, a multi-turn coil of electrically conductive material positioned adjacent said adjacent ends, said coil having at least a pair of taps one on each side of its center plane, means connecting a pair of said taps to respective adjacent ends of said dipole members, a disc of electrically conductive material to affect the inductance of said coil positioned within said coil and rotatable about a diameter of said coil from a first position where the plane of said disc is perpendicular to the axis of said coil to a second position, motor means for rotating said disc between said positions and means remote from said antenna for actuating said motor whereby said antenna may be electrically tuned from a remote point and wherein said disc is positioned midway between the ends of said coil, the spacing between the remote ends of said dipole elements being electrically equal to a resonant frequency higher than the maximum frequency band of operation, said pair of taps closest to said center plane when connected to said adjacent ends of said dipole lowering the resonant frequency to adjacent the lower frequency of said maximum frequency band of operation, said disc when rotated increasing and decreasing the resonant frequency to a frequency approximating that of the highest and lowest frequencies respectively of said maximum frequency band of operation.

3. The antenna of claim 2 including a loop of at least one turn coaxial with said coil and symmetrical to the center plane thereof, said loop having terminals adapted to be connected to the conductors of a coaxial cable connecting to a radio transmitter.

4. The antenna of claim 2 including a rigid housing located adjacent the mid point of said antenna, the adjacent ends of said dipole elements extending into said housing, said coil, said means for connecting said taps on said coil to said elements and said motor being positioned within said housing, said dipole elements being rigidly supported in said housing and having a rigidity to remain generally straight when said housing is supported in an elevated position.

5. A remotely-tunable, band switchable radio antenna comprising in combination a pair of aligned dipole elements having adjacent ends, the spacing of the remote ends of said antenna providing a resonant frequency above the highest frequency of the highest frequency band of operation, a multi-turn coil positioned adjacent the adjacent ends of said dipole elements, a plurality of pairs of taps on said coil each pair being symmetrically located relative to the center plane thereof, relay means for selectively connecting pairs of symmetrical taps to respective adjacent ends of said dipole elements whereby the frequency band of operation of said antenna may be readily changed, the minimum resonant frequency of said elements and the portion of said coil between taps being less than the lowest frequency of each respective band of operation and means within said coil for raising the resonant frequency, said means including an electrically conductive disc member mounted for rotation on a diametrical axis of said coil through the mid plane of said coil, said disc being rotatable from a position where its plane is perpendicular to the axis of the coil to where its plane is parallel to the axis of said coil whereby the inductance of said coil may be adjusted and motor means for rotating said disc.

6. The antenna of claim 1 wherein said disc is magnetically permeable.

7. The antenna of claim 1 including a loop of at least one turn coaxial with said coil and symmetrical to the center plane thereof, said loop having terminals adapted to be connected to the conductors of a coaxial cable connecting to a radio transmitter.

8. The antenna of claim 2 wherein means are provided for connecting selected pairs of spaced taps to the adjacent ends of said dipole elements whereby the frequency band of operation may be changed.

9. A tunable antenna comprised of first and second radiating elements having an overall length such that its resonant frequency is higher than the maximum frequency of operation for said antenna, a multi-turn cylindrical loading coil having spaced turns and at least two spaced taps, means connecting at least one of said radiating elements to one of said spaced taps, means for coupling said loading coil to a transmission line and a metallic disc electrically isolated from said coil symmetrically positioned within said coil between said taps, said disc being rotatable about an axis in its plane, said axis being on a diameter of said coil and orthogonal to the axis of said coil whereby the resonant frequency of said antenna is affected by rotation of said disc.

10. The antenna of claim 9 having two linear radiating elements axially in line with said loading coil and having an overall length such that their unloaded resonant frequency is greater than the maximum frequency of operation for said antenna.

11. The antenna of claim 10 having adjustable tips telescoped into the outboard ends of said radiating elements.

* * * * *